US005595080A

United States Patent [19]

Whinton

[11] Patent Number: 5,595,080

[45] Date of Patent: Jan. 21, 1997

[54] LOCK CONDITION INDICATOR DEVICE

[76] Inventor: Mark J. Whinton, R.R. #22, Cambridge, Ontario, Canada, N3C 2V4

[21] Appl. No.: 523,645

[22] Filed: Sep. 5, 1995

[51] Int. Cl.[6] ..... E05B 41/00

[52] U.S. Cl. ..... 70/432; 70/395; 70/438

[58] Field of Search ..... 70/432, 395, 401, 70/436, 438, 439, 441; 411/349, 550, 551, 552, 553

[56] References Cited

U.S. PATENT DOCUMENTS

| | | | |
|---|---|---|---|
| 729,773 | 6/1903 | Katz et al. | 70/395 |
| 1,237,115 | 8/1917 | Stein | 70/395 |
| 1,843,335 | 2/1932 | Oberfield | 70/395 |
| 2,176,465 | 10/1939 | Merkl | 70/395 |
| 2,198,484 | 4/1940 | Merkl | 70/395 |
| 2,418,046 | 3/1947 | Oberfield | 70/395 |
| 2,561,944 | 7/1951 | Oberfield | 70/395 |
| 2,631,348 | 3/1953 | Bailey | 411/349 |
| 4,432,218 | 2/1984 | Hoener | 70/395 |
| 4,440,011 | 4/1984 | Klein | 70/438 |
| 4,631,943 | 12/1986 | Hoener | 70/395 |
| 4,908,605 | 3/1990 | Takatsuka | 340/542 |
| 4,936,896 | 6/1990 | Takatsuka | 70/432 |
| 5,435,160 | 7/1995 | Linsalato et al. | 70/408 |

FOREIGN PATENT DOCUMENTS

| | | | |
|---|---|---|---|
| 2632002 | 12/1989 | France | 70/432 |
| 2634969 | 2/1978 | Germany . | |
| 404038382 | 2/1992 | Japan | 70/432 |
| 202201 | 1/1939 | Switzerland . | |

*Primary Examiner*—Steven N. Meyers
*Assistant Examiner*—Donald J. Lecher
*Attorney, Agent, or Firm*—R. Craig Armstrong

[57] ABSTRACT

A lock condition indicator device which is adapted for affixation to a key for a cylinder lock has a substantially circular movable means adapted to be retained in juxtaposition to a head portion of the key, but rotatable about a longitudinal axis of the key when an engaging means on the circumference of the movable means encounters an obstructing means on an outer surface of the lock, resulting in the movable means being rotated into one of a plurality of indicator positions.

7 Claims, 3 Drawing Sheets

LOCK CONDITION INDICATOR DEVICE

BACKGROUND OF THE INVENTION

This invention relates to a device for use with a key for a cylinder lock to indicate the last operation performed on the lock by the key, thus indicating whether the lock is in the locked or unlocked position. If, after leaving premises, a person having primary responsibility for locking the premises is uncertain whether the lock was secured, the status of the lock can be ascertained by a glance at the key without the need to return to the premises.

Devices have been suggested having the object of indicating the status of a lock. These have suffered from the disadvantages of including small moving parts, such as small springs, or having complicated construction. A further disadvantage with previous devices is that they are only capable of giving an accurate indication of the status of a lock if used with extreme care, particularly with precision in turning the key in the lock, and are not adapted to maintain their accuracy where used in more realistically predictable conditions of possible slight over-rotation in the lock, attempts to insert or remove the key at a position slightly out of the correct alignment, or somewhat rougher than ideal handling.

SUMMARY OF THE INVENTION

It has been found that a simple, durable and reliably accurate device can be made without small parts, particularly moving parts, designed to operate with standard types of key or lock face, and readily adaptable with minor modification for different types. The device has one moving part which includes an indicator having discrete portions, of which an appropriate one is visible to correspond to the lock status.

A lock indicator device which is adapted for affixation to a key for a cylinder lock has a substantially circular movable means adapted to be retained in juxtaposition to a head portion of the key, but rotatable about a longitudinal axis of the key when an engaging means on the circumference of the movable means encounters an obstructing means on an outer surface of the lock, so that the movable means is rotated into the appropriate indicator position. The engaging means can be any simple irregularity in the circumference of the movable means, such as a recessed portion or two projections.

The movable means can also be moved manually for the situation where more than one person has a key to the lock, but the construction of the device is such that accidental movement from one indicator position to the other is avoided.

BRIEF DESCRIPTION OF THE DRAWINGS

The invention will now be described with reference to preferred embodiments by way of example, as illustrated in the accompanying drawings, in which.

DETAILED DESCRIPTION OF THE PREFERRED EMBODIMENTS

Figure 1:
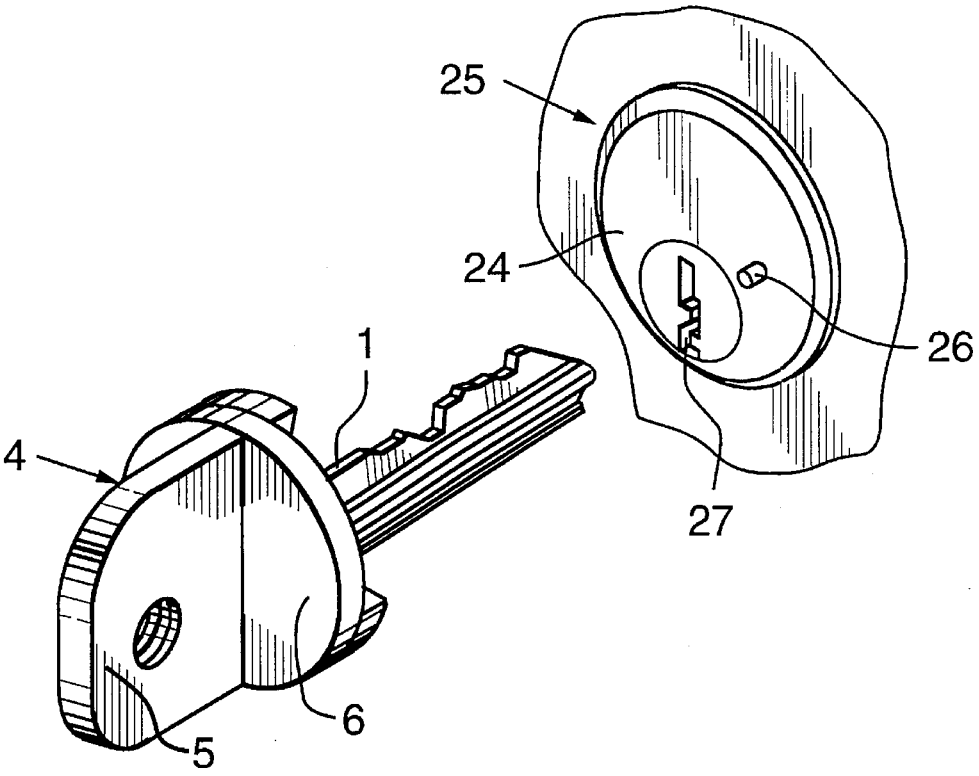
FIG. 1 is a perspective view of a key and lock incorporating a first embodiment of the invention.
Figure 2:
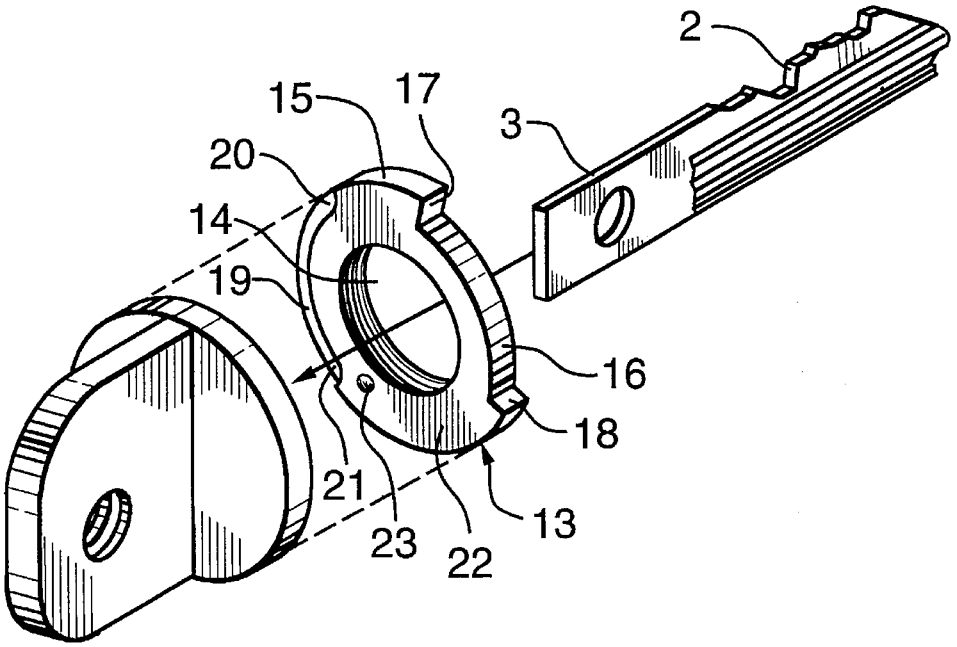
FIGS. 2 and 3 are exploded views of the key shown in FIG. 1.
Figure 3:
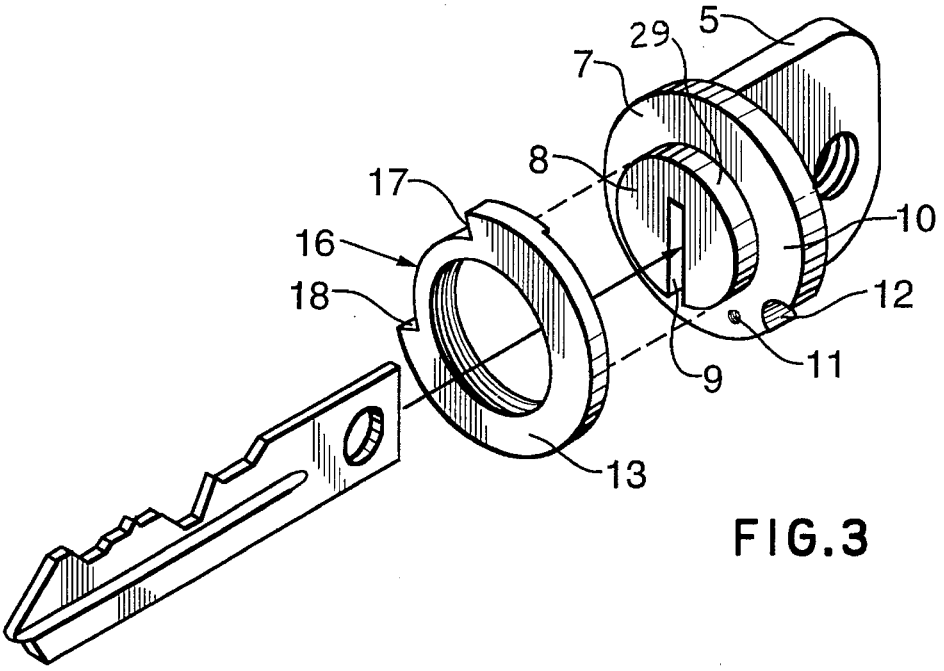
Figure 4:
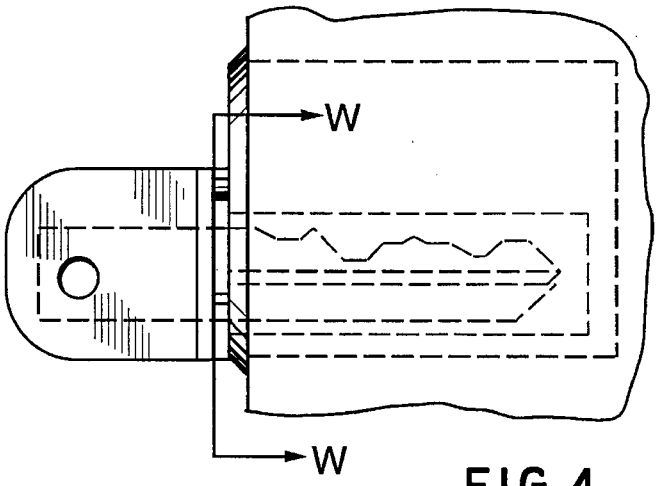
FIG. 4 is a side view of the key shown in FIG. 1 in a lock.

Referring to FIGS. 1, 2 and 3, a key 1 comprises a toothed bit portion 2 and a shank 3, which is mounted by any suitable means, such as a pressure fit, into a head 4. Referring to FIG. 3, the head has a handhold portion 5, to which is affixed a stationary disc 6, comprising an outer disc portion 7 and an inner retaining disc portion 8. Within the disc portions and preferably extending into the handhold portion 5 is a slot 9 into which the key shank 3 can be mounted.

Referring to FIG. 2, a substantially disc-shaped movable means 13 comprises a central hole 14, which is adapted to engage the inner retaining disc portion 8 of the stationary disc 6 securely in the direction of the longitudinal axis of the key, but without inhibiting the sliding rotation of the movable means about the inner retaining disc. A recess 16, having extremities 17 and 18, is provided within part of the circumference 15 of the movable means 13. An indicator portion 19, having extremities 20 and 21, comprises a recess in the planar surface 22, and is located so that surface markings can be appropriately visible through an aperture 12 in the outer disc 7 of the stationary disc 6. A projection 23 on the planar surface 22 is adapted to engage a detent 11 in the adjacent planar surface 10 of the stationary disc 6.

Figure 5:
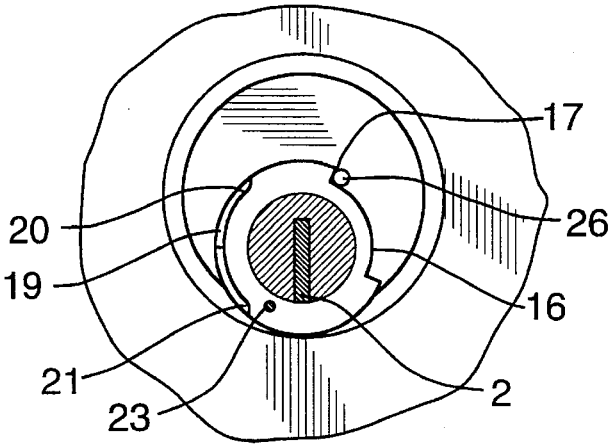
FIG. 5 is a sectional view along the line W—W in FIG. 4.
Figure 6:
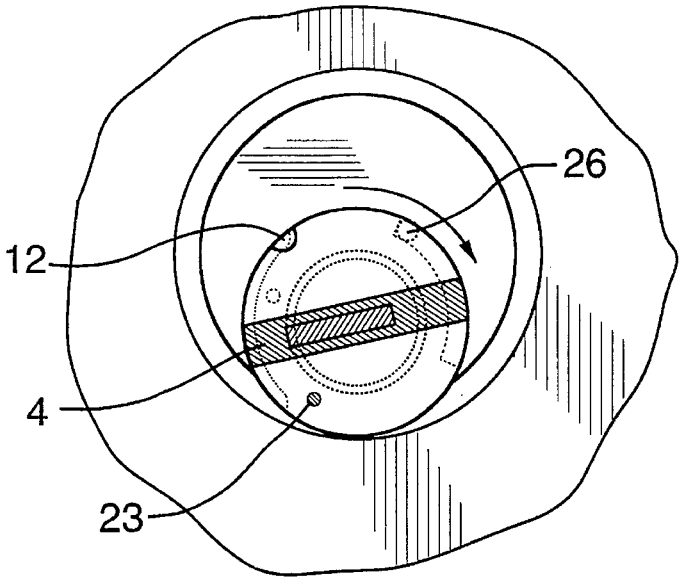
FIGS. 6 and 7 are top elevational views of the embodiment shown in FIG. 1, showing the turning operation of the key for locking and unlocking the lock.
Figure 7:
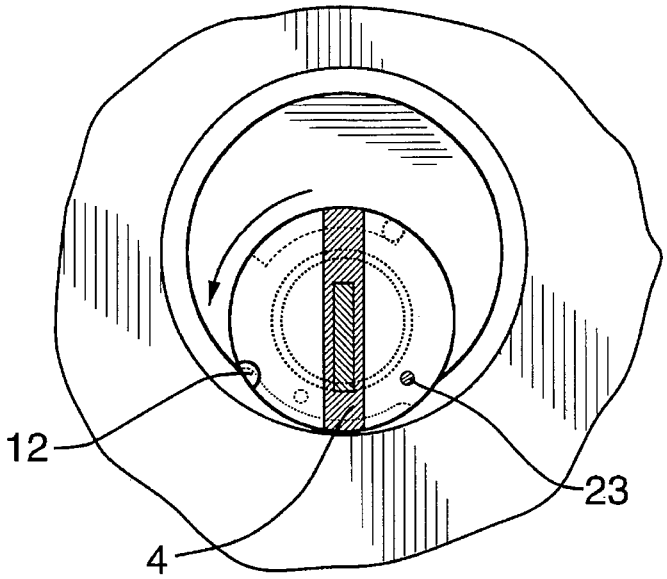

On the surface 24 of a corresponding lock 25, a pin 26 is affixed in a position to engage the extremities 17 and 18 of the recess 16 on the circumference of the movable means 13, when the key is turned in the keyhole 27, Referring to FIGS. 5, 6 and 7, the operation of the device can be seen. As the key bit portion 2 is inserted in the keyhole 27, it can be turned clockwise from the position shown in section in FIG. 5 to the position shown in FIG. 6. During this rotation, the 26 pin obstructs and engages the extremity 17 of the recess 16, and as the rotation continues, the movable means is rotated counter-clockwise until the appropriate indicator is visible through the aperture 12. The key is then counter-rotated for the distance required to enable withdrawal from the lock. As can be seen from FIGS. 6 and 7, this counter-rotation does not affect the relative positions of the stationary disc portion and the movable means, and the indicator remains at the appropriate position. The location of the projection 23 and the detent 11 are set so that they will become aligned and will engage when the locking or unlocking process is complete, thus assisting retention of the movable means in the appropriate position, and reducing the possibility of accidental moving of the movable means which could result in an inaccurate indication of the lock status.

The reverse occurs for the reverse process, in which counter-clockwise turning of the key results in the obstruction and engagement of the extremity 18 by the pin 26, so that the movable means is rotated clockwise until the indicator shows the appropriate new position.

The indicator portion 19 can be marked with any suitable symbols or colours, to indicate whether the lock is in an unlocked or locked position. If the proportion of the circumferential length of the recess 16 to the circumference of the movable means is substantially as shown in FIG. 3, there will be ample total rotation of the movable means for each locking or unlocking procedure to ensure that the indicator portion moves the complete distance required to be fully in the appropriate position.

For additional safeguarding of the retention of the movable means in the appropriate position, and to prevent accidental movement of the movable means, it has been found advantageous to provide the inner surface of the central hole 14 of the movable means 13 with either a convex or a concave circumferential band (not shown), adapted to engage a compatible concave or convex band on the outer side wall 29 of the inner retaining disc portion 8 of the stationary disc 6.

Figure 8:
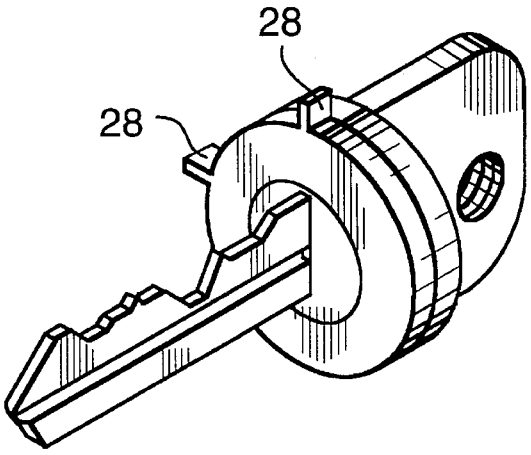
FIG. 8 is a perspective view of a key of a second embodiment of the invention.

As a further embodiment, referring to FIG. 8, the movable means 13 is provided with two projections 28, located on the circumference so as to engage the pin 26, and perform the same function as the extremities 17 and 18 of the recess 16.

It can be seen that the appropriate configuration of the recess and the indicator portion on the movable means, and the proper location of the pin 26, is determined by whether the particular lock is locked by a clockwise or a counterclockwise turn. The invention can thus readily be adapted for either type of lock.

What is claimed as the invention is:

1. A lock condition indicator device for use with a corresponding cylinder lock, said lock having a pin projecting therefrom, said device comprising:

a key head and a shank extending from said head, said head having an outer disc with a flat surface perpendicular to said shank and an inner disc extending outwardly from said flat surface;

a disc rotatably mounted around said inner disc, said rotatable disc having engaging means on its circumference for engaging said pin extending from said lock, such that said rotatable disc is rotated into one of a plurality of indicator positions as said key head is turned in said lock permitting the status of the lock to be ascertained from said key.

2. A lock condition indicator device as claimed in claim 1, wherein said engaging means comprises two projections from the circumference of said rotatable disc.

3. A lock condition indicator device as claimed in claim 1 wherein said engaging means comprises a recessed area along a portion of the circumference of said rotatable disc.

4. A lock condition indicator device as claimed in claim 1 wherein the head comprises at least one projection and at least one detent provided on opposing surfaces of said outer disc and said rotatable disc being capable of interacting to retain said rotating disc in an appropriate indicator position after rotation thereto by operation of said key in said lock.

5. A lock condition indicator device as claimed in claim 4, wherein said outer disc comprises an aperture, and said rotatable disc has on a planar surface adjacent to said outer disc an indicator means comprising an indicator portion able to be marked with any suitable colors or symbols to correspond to different conditions of said lock, located so as to be visible through said aperture.

6. A lock condition indicator device as claimed in claim 1, where said rotatable disk is rotatably mounted around said inner disk by virtue of one having an annular concave surface, engaging an annular convex surface in the other.

7. A lock condition indicator device as claimed in claim 5, where said rotatable disk is rotatably mounted around said inner disk by virtue of one having an annular concave surface, engaging an annular convex surface in the other.

* * * * *